US008016079B1

(12) United States Patent
Huls

(10) Patent No.: US 8,016,079 B1
(45) Date of Patent: Sep. 13, 2011

(54) FOLD OUT SAWHORSE WITH PIVOTABLE, CANTILEVERED SUPPORT MEMBERS

(76) Inventor: Darryl W. Huls, Jasper, IN (US)

( * ) Notice: Subject to any disclaimer, the term of this patent is extended or adjusted under 35 U.S.C. 154(b) by 545 days.

(21) Appl. No.: 12/052,685

(22) Filed: Mar. 20, 2008

(51) Int. Cl.
*B25H 1/00* (2006.01)

(52) U.S. Cl. ..... 182/181.1; 182/152; 182/153; 182/155; 182/179.1; 182/186.5

(58) Field of Classification Search ..... 182/45, 182/152, 153, 155, 179.1, 181.1, 186.5; 248/237
See application file for complete search history.

(56) References Cited

U.S. PATENT DOCUMENTS

| | | | | | |
|---|---|---|---|---|---|
| 293,847 | A | | 2/1884 | Bremer | |
| 403,636 | A | * | 5/1889 | Bitterly | 182/20 |
| 472,867 | A | * | 4/1892 | Farland | 248/237 |
| 829,312 | A | * | 8/1906 | Alberty | 248/237 |
| 1,365,996 | A | * | 1/1921 | Herwick | 182/45 |
| 1,452,717 | A | * | 4/1923 | Wertz | 182/20 |
| 1,620,061 | A | * | 3/1927 | Blair | 182/225 |
| 1,742,637 | A | | 1/1930 | Dearborn | |
| 2,275,014 | A | * | 3/1942 | Hahler | 248/237 |
| 2,824,771 | A | | 2/1958 | Blenski | |
| 2,859,066 | A | * | 11/1958 | Franklin | 182/225 |
| 2,874,003 | A | * | 2/1959 | Humphries | 182/153 |
| 3,388,771 | A | * | 6/1968 | Corneliusen | 182/153 |
| 3,741,338 | A | * | 6/1973 | Durand et al. | 182/155 |
| 4,260,040 | A | | 4/1981 | Kieffer | |
| 5,402,860 | A | | 4/1995 | Fry | |
| 5,535,847 | A | | 7/1996 | DuRapau | |
| 5,960,904 | A | * | 10/1999 | Ullmann | 182/45 |
| 6,155,318 | A | | 12/2000 | Underwood | |
| 6,269,905 | B1 | * | 8/2001 | Smith | 182/45 |
| 6,286,824 | B1 | | 9/2001 | Sagol | |

FOREIGN PATENT DOCUMENTS

| | | |
|---|---|---|
| CA | 1.123.877 | 5/1982 |
| GB | 179.470 | 5/1922 |
| WO | WO2007/082565 | 7/2007 |

* cited by examiner

*Primary Examiner* — Katherine Mitchell
*Assistant Examiner* — Colleen M Quinn
(74) *Attorney, Agent, or Firm* — Michael I. Kroll

(57) ABSTRACT

A sawhorse having a pair of legs supporting a beam and a pair of corresponding cantilevered support member with each hingedly attached across the beam members whereby the legs can be divergently extended with a spanner fastened to opposing legs restricting the angular separation. The user selectively moves one or both of the fold outs as needed creating a desired work surface on a horizontal plane.

5 Claims, 9 Drawing Sheets

FOLD OUT SAWHORSE WITH PIVOTABLE, CANTILEVERED SUPPORT MEMBERS

BACKGROUND OF THE INVENTION

1. Field of the Invention

Figure 1:
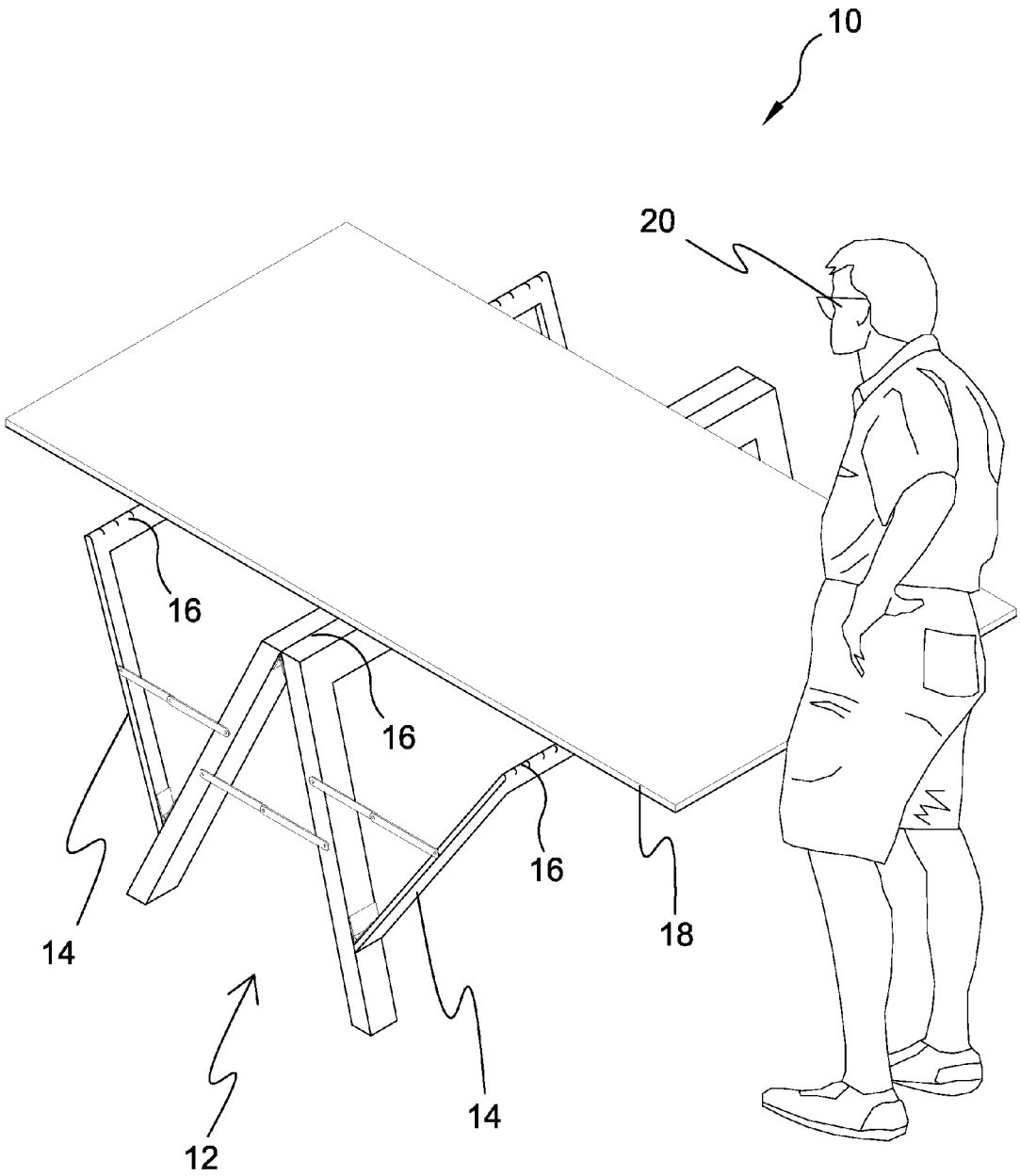

The present invention relates generally to supports and, more specifically, to a sawhorse having a pair of legs supporting a beam and a corresponding similar member with each hingedly attached across the beam members whereby the legs can be divergently extended with a spanner fastened to opposing legs restricting the angular separation. A cantilevered legs supported beam is hingedly attached to a corresponding sawhorse leg creating a fold out with the additional beam in co-planar alignment with the main sawhorse beams forming a level support surface. An opposing cantilevered extension member is fastened to the other side providing a second fold out support which is also co-planar with the other beam members. The user selectively moves one or both of the foldouts as needed creating a desired work surface.

2. Description of the Prior Art

There are other foldable device designed for support. Typical of these is U.S. Pat. No. 293,847 issued to Bremer on Feb. 19, 1884.

Another patent was issued to Dearborn on Jan. 7, 1930 as U.S. Pat. No. 1,742,637. Yet another U.S. Pat. No. 2,824,771 was issued to Blenski on Feb. 25, 1958 and still yet another was issued on Apr. 7, 1981 to Kieffer as U.S. Pat. No. 4,260,040.

Another patent was issued to Fry on U.S. Pat. No. 5,402,860 as U.S. Pat. No. 5,402,860. Yet another U.S. Pat. No. 5,535,847 was issued to DuRapau on Jul. 16, 1996. Another was issued to Underwood on Dec. 5, 2000 as U.S. Pat. No. 6,155,318 and still yet another was issued on Sep. 11, 2001 to Sagol as U.S. Pat. No. 6,286,824.

Another patent was issued to Hiskins on May 11, 1922 as U.K. Patent No. GB179,470. Yet another Patent CA1123877 was issued to Brun on May 18, 1982. Another was issued to Strauss on Jul. 26, 2007 as International Patent Application No. WO 2007/082565.

U.S. Pat. No. 293,847

Inventor: Heinrich Bremer

Issued: Feb. 19, 1884

The invention is a folding wash stand comprising three horizontal bars, A, B, and C, each supported at its outer end upon an upright or leg, D, and all, when the device is open, converging toward a common center. In addition to the leg D, described as supporting the outer end of bar A, there is another leg, D', situated near the inner end of said bar, which serves as the central support of the horse when in the position shown in FIGS. 1 and 2. The bars A and. B are beveled at their inner ends, the bevels cut in opposite directions, so as to form, when brought together, a close joint. These bars are joined together by means of hinge E. Bar C is hinged to bar A by means of hinge F, and said bar is provided on its inner end with a V-shaped groove or recess, a, into which the beveled ends of bars A and B enter when the device is expanded for use.

U.S. Pat. No. 1,742,637

Inventor: Clayton M. Dearborn

Issued: Jan. 7, 1930

A horse of the character described having an extensible leg comprising two sections overlapping each other, means for securing said sections together in different positions of adjustment comprising a clamp embracing both sections and slidable on said leg but operative to lock the two sections together, and a latch carried by one of said sections for holding said clamp in its operative position, said latch being operable to release the clamp.

U.S. Pat. No. 2,824,771

Inventor: Joseph Blenski

Issued: Feb. 25, 1958

A portable sawhorse comprising, an elongated, inverted substantially U-shaped work-supporting-beam having the side walls thereof provided with opposed sets of spaced integral and inwardly directed wedge draped lugs on their adjacent surfaces near opposite ends of said beam, the lug of each set nearest to the end of said beam being larger than and located slightly above the other lug of said set, supporting legs pivotally secured to the side walls of said beam above and between the lugs of each set for nesting in the space between the walls and for swinging movement in a plane parallel to the plane of the wall to which the respective legs are secured and into seated position within the space between the lugs of the adjacent set and means cooperable with each pair of opposing legs for positively maintaining the same in spaced condition and in position within their respective seats.

U.S. Pat. No. 4,260,040

Inventor: Vincent C. Kieffer

Issued: Apr. 7, 1981

A sawhorse having a crossbar and support legs at each end of the crossbar is provided with a workpiece support member supported on the sawhorse at a position laterally offset from the crossbar and at least as high as the crossbar. A second workpiece support member may be arranged on the opposite side of the crossbar and third and fourth workpiece support members may be provided in longitudinally spaced relation from the first and second workpiece support members respectively. The workpiece support members may have flat top surfaces disposed in a common plane situated higher than the crossbar so that a workpiece supported thereon may be cut along a line directed between the workpiece support members and either parallel to or perpendicular to the sawhorse crossbar with both cut portions of the workpiece supported on the workpiece support members.

U.S. Pat. No. 5,402,860

Inventor: Daniel L. Fry

Issued: Apr. 4, 1995

Configured to resemble a classic sawhorse the invention is formed of rectangular metal tubes and "I" beams that are attached to and contained within a main beam. Side mounted tubes swing out and extend tubular members contained within them. "I" beams extend from the main beam and extend channel beams transverse to the longitudinal axis. Through a series of holes and pins the beam extensions and the supporting legs are adjustable over a wide range.

U.S. Pat. No. 5,535,847

Inventor: Kenrick J. DuRapau

Issued: Jul. 16, 1996

A table top attachment for a sawhorse includes a table top member and a brace member. The table top member has a planar top surface and a lower surface that includes a series of tab members that snugly mate with the top beam of a sawhorse in an attached position to prevent the table top member from moving laterally with respect to the top beam and allowing the top beam to support the table top member. The brace member is connected at one end to the table top member along one edge of the table top and at an opposite end to one of the sawhorse side supports. When connected to the sawhorse side support the brace cooperates with the sawhorse top beam to support the table top in the attached position.

U.S. Pat. No. 6,155,318

Inventor: William D. Underwood

Issued: Dec. 5, 2000

An adjustable portable saw support, device, assembly, unit, kit, or the like or table or bench formed of spaced metal triangular shaped base units, a cross support or brace which supports a chop saw, radial arm saw, miter saw, or the like, and can have elongated 2".times.4" or 2".times.6" legs secured to each of the base units like a sawhorse. Without legs, the base units can rest in the bed of a pickup, on a tailgate, or on a floor. With legs added thereto, the unit can be raised to any desired height. The portable saw support may be used without a saw as a work table or lumber support surface for use with a hand held drill, circular saw, router, or other power or hand tools. Swing arm supports can support, for example, a plurality of 2".times.10" or 2".times.12" members or lumber laid adjacent one another to provide a large working surface. Each base unit can include an adjustable horizontal end brace or support member which can support one or two 2".times.10" members or boards on the upper surface thereof to form a work surface adjacent the saw or without a saw. Insertion of the 2'.times.6" member into the top of the base unit locks the end brace into position and forms an extension to the right or left of the saw which can extend for 5, 10, 15, 20, or more feet. If a saw is used, it is attached to spaced mounting brackets or supports on a cross-brace is attached to vertical adjustment cross-brace support brackets on the inside of each of the base units. The cross-brace support brackets are adjusted so that the working surface of the saw is raised to the desired level, usually the same height as the 2".times.6" members inserted in the tops of the base units.

U.S. Pat. No. 6,286,824

Inventor: Sami Sagol

Issued: Sep. 11, 2001

The invention relates to a worktable mountable on a sawhorse, the sawhorse including two frames articulated to one another along a longitudinal top axis, and a top bar having two side faces extending parallel to the longitudinal axis. The worktable includes a top bar receiving member and at least one work plate articulated thereto, the top bar receiving member including a receiving portion fitted for snugly receiving the top bar and at least one support leg for supporting the at least one work plate at a substantially horizontal position.

U.K. Patent Number GB179,470

Inventor: William Hiskins

Issued: May 11, 1922

A collapsible saw-horse is formed of three pairs of pivoted legs A, connected together by cross supports D, and capable of being opened to an adjustable extent and held in position by a chain H fixed to one leg at B and secured to a catch C on one of the other legs. The intermediate pair of legs is nearer to one of the end pairs than to the other, so that short logs can be supported between the two pairs of legs that are near together. A chain H may be used for each pair of legs.

Canada Patent Number CA1123877

Inventor: Robert Brun

Issued: May 18, 1982

A collapsible saw-horse is disclosed, comprising a beam and two frames extending side by side from the underside and longitudinally of the beam, and each forming a pair of legs for supporting the beam. Each frame consists of a single bent tubular member defining two upright leg portions and an intermediate bight portion at the lower end of the leg portions. The upper ends of the leg portions are bent back and inserted within brackets secured to the underside of the beam. One frame is rigidly secured to the brackets by screws extending through the brackets to take a collapsed position parallel to the first frame and an operative beam-supporting position diverging from the first frame. A pair of pivoted toggle arms link the two frames to prevent the pivotable frame from spreading beyond a predetermined limit angle with respect to the fixed frame.

International Patent Application Number WO 2007/082565

Inventor: Ralf Strauss

Issued: Jul. 26, 2007

In a trestle (1), in particular a sawhorse, with a pivot joint (13), with at least two support legs (3, 5) which extend from the pivot joint and which, by means of the pivot joint, can be pivoted relative to one another into a trestle position providing a stable standing position for the trestle on a support base, and with a fixing arrangement (21) by means of which at least one upward pivoting movement of the support legs from said trestle position is blocked, provision is made for at least one of the support legs to be able to pivot upwards with respect to the other support leg about the pivot joint and beyond the trestle position substantially into a horizontal orientation in which the pivoted-up support leg can be set down on, and particularly fastened to, a rest situated higher than the support base.

While these foldable support devices may be suitable for the purposes for which they were designed, they would not be as suitable for the purposes of the present invention, as hereinafter described.

SUMMARY OF THE PRESENT INVENTION

A primary object of the present invention is to provide a workpiece support that is expandable to accommodate various sized workpieces.

Another object of the present invention is to provide a sawhorse having pivotal supports that can be extended or contracted as needed.

Yet another object of the present invention is to provide a sawhorse that is foldable to a planar form.

Still yet another object of the present invention is to provide a sawhorse having a left and right side that are movable with respect to one another.

Another object of the present invention is to provide a sawhorse wherein said left and right sides are correspondingly similar.

Yet another object of the present invention is to provide a sawhorse where the left and right side are hinged approximate the top with a spanner therebetween extending between corresponding legs whereby the saw horse can be unfold to an A-frame configuration.

Still yet another object of the present invention is to provide a sawhorse where the left and right side each have a hinged, cantilevered support member of similar dimension but with shorter legs where the base of the shorter legs are hingedly fastened to a respective sawhorse leg so that it may be pivoted outwardly forming a co-planar support between the saw horse top beam and the pivotal extension top beam.

Another object of the present invention is to provide a sawhorse where either one or both hinged support members can be selectively extended creating a variably dimensioned workpiece support.

Another object of the present invention is to provide a sawhorse where the hinged support members and corresponding sawhorse legs have a spanner therebetween whereby the hinged support can be lockingly engaged in the extended position.

Additional objects of the present invention will appear as the description proceeds.

The present invention overcomes the shortcomings of the prior art by providing a sawhorse having a pair of legs supporting a beam and a corresponding cantilevered support member with each hingedly attached across the beam members whereby the legs can be divergently extended with a spanner fastened to opposing legs restricting the angular separation. An opposing cantilevered support member is hingedly attached to a corresponding sawhorse leg creating a fold out with the additional beam in co-planar alignment with the main sawhorse beams forming a level support surface. A similar extension member is fastened to the other side providing a second fold out support which is also co-planar with the other beam members. The user selective moves one or both of the fold outs as needed creating a desired work surface.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
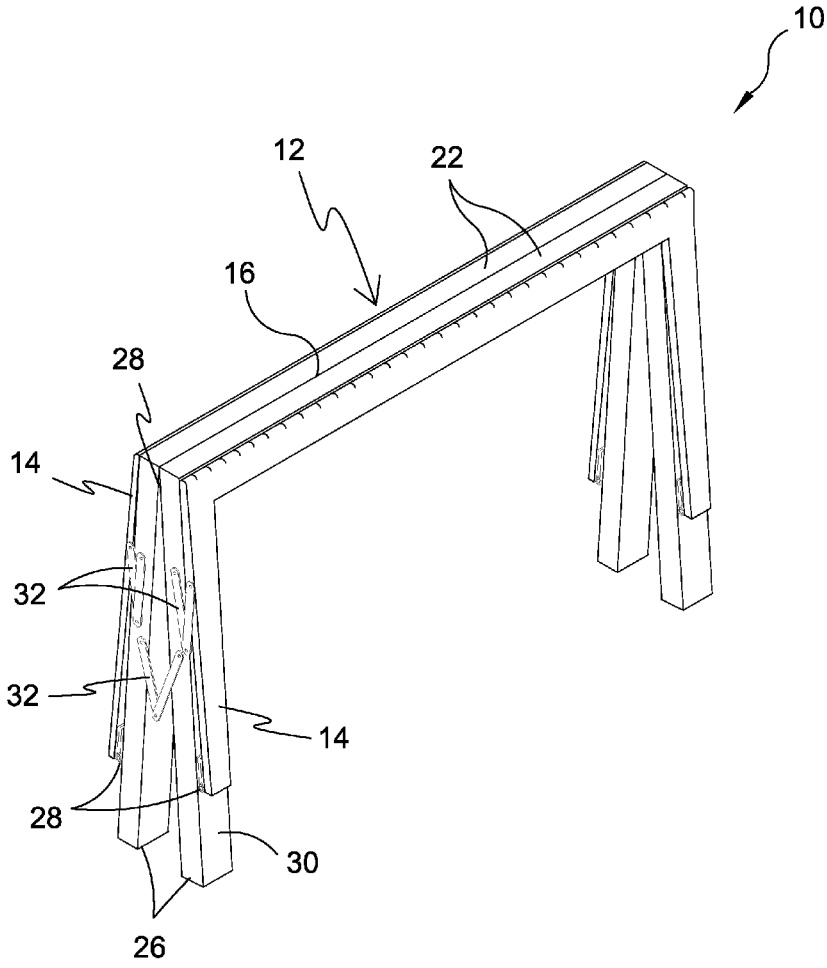
Figure 3:
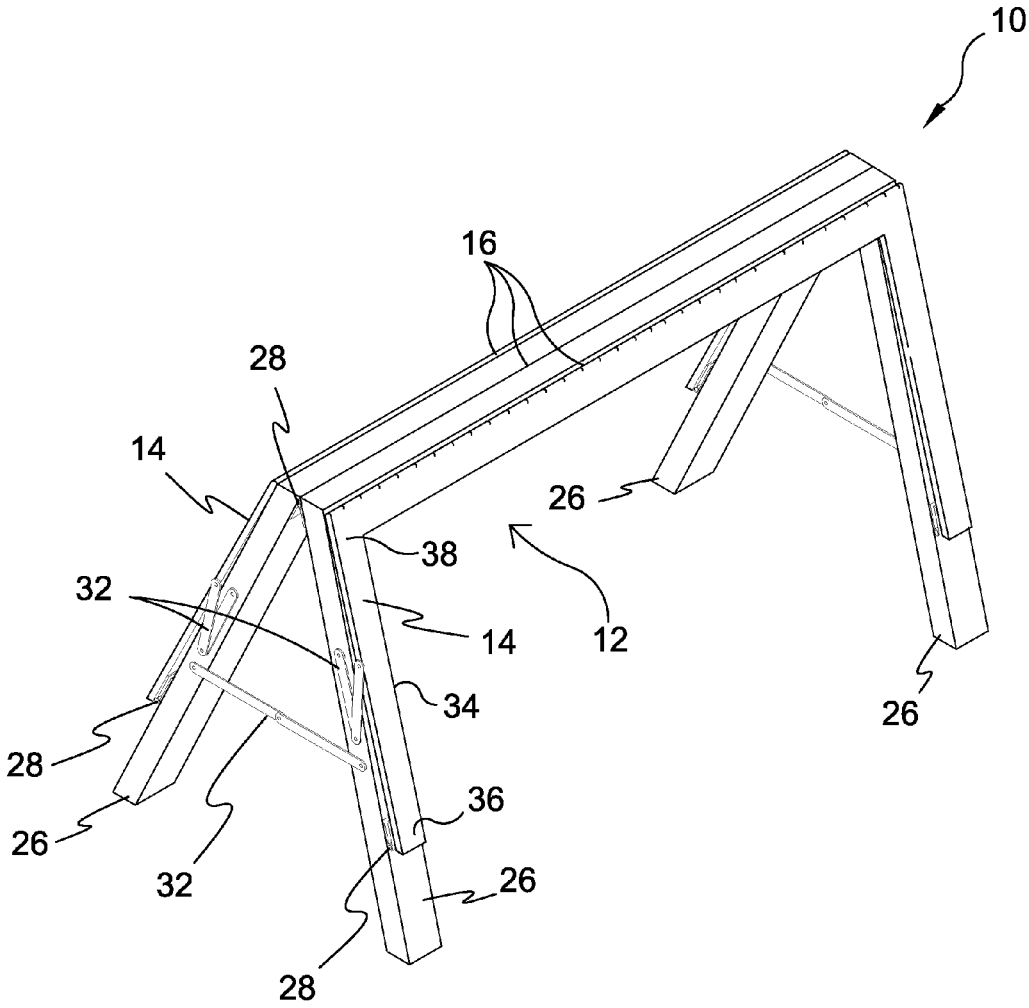
Figure 4:
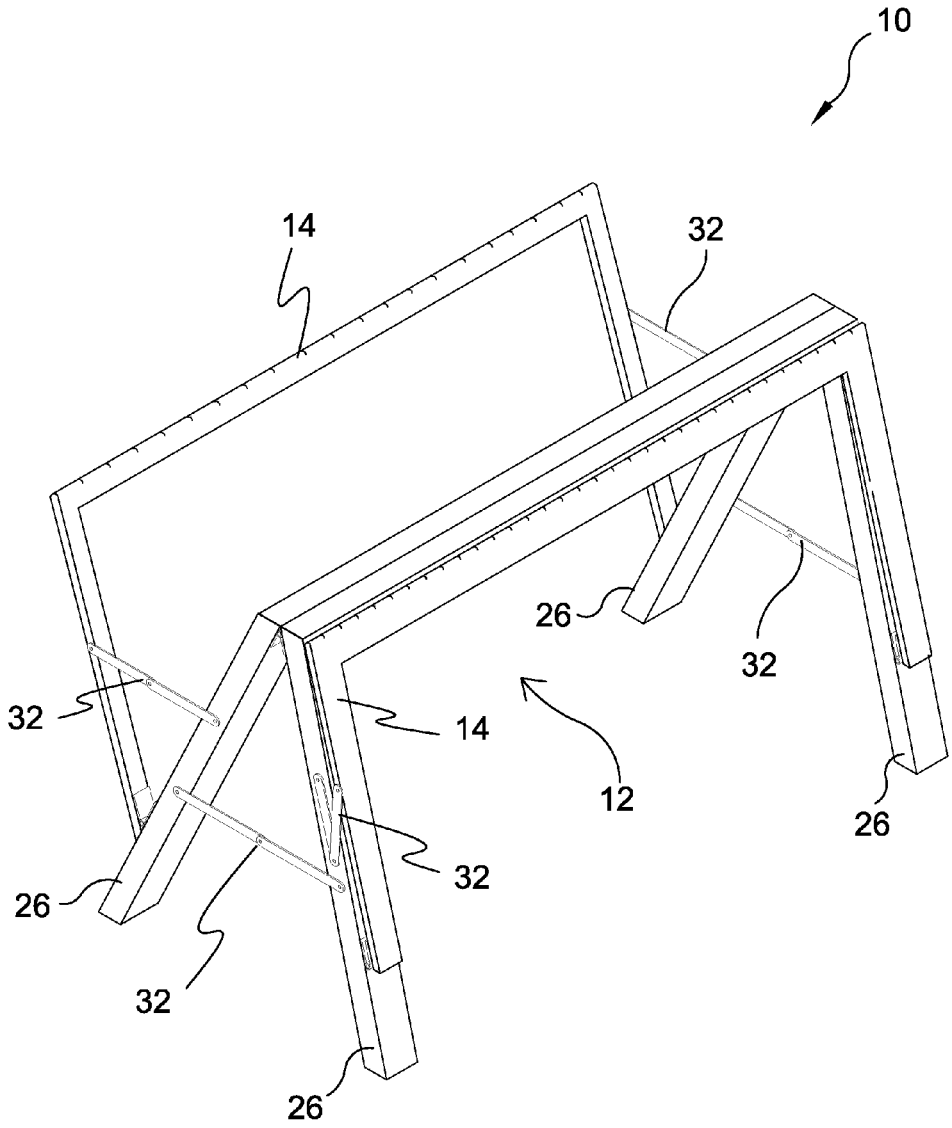
Figure 5:
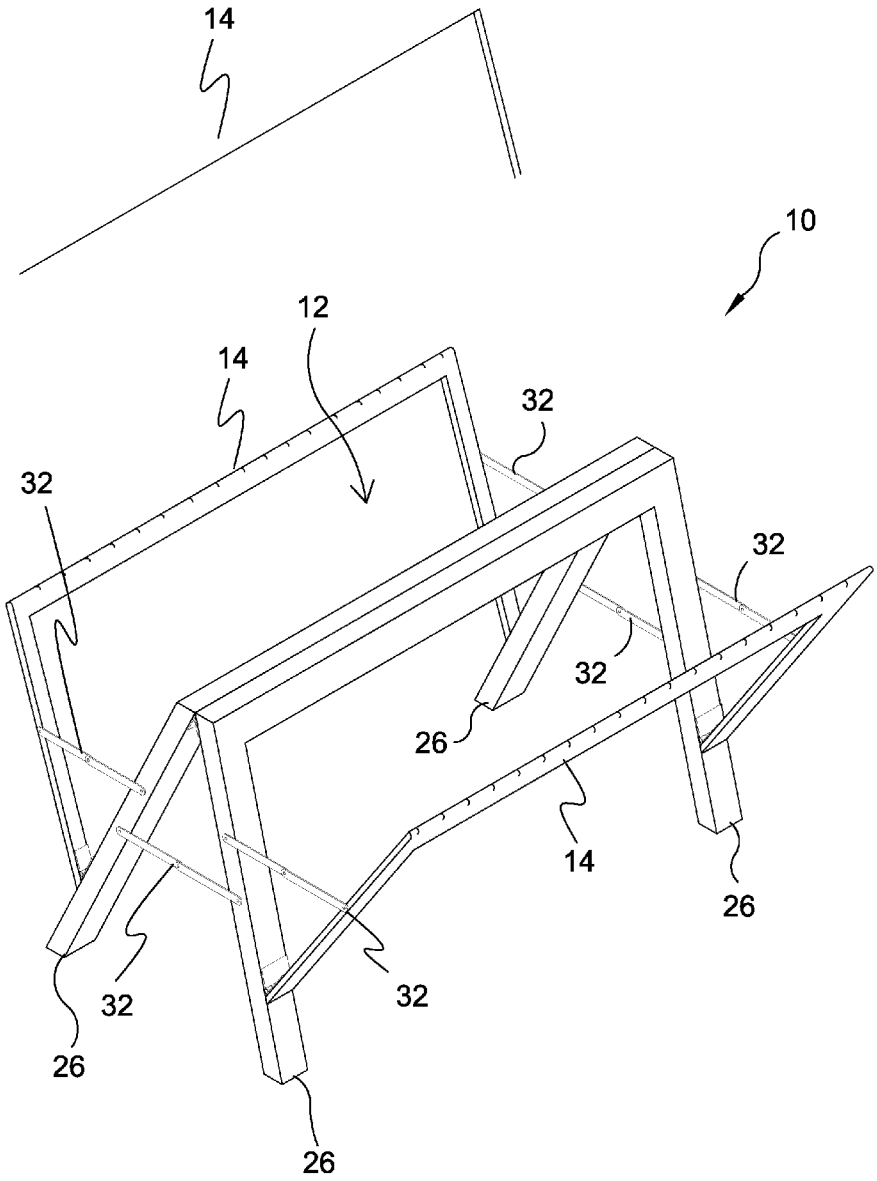
Figure 6:
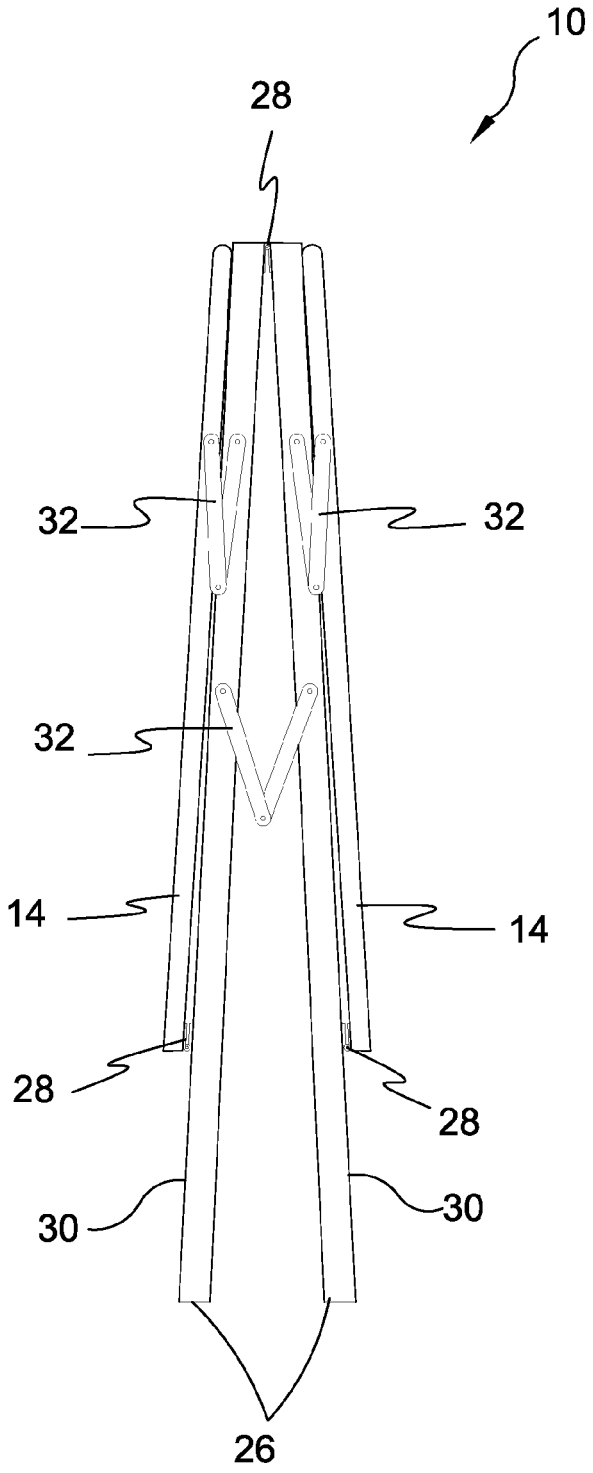
Figure 7:
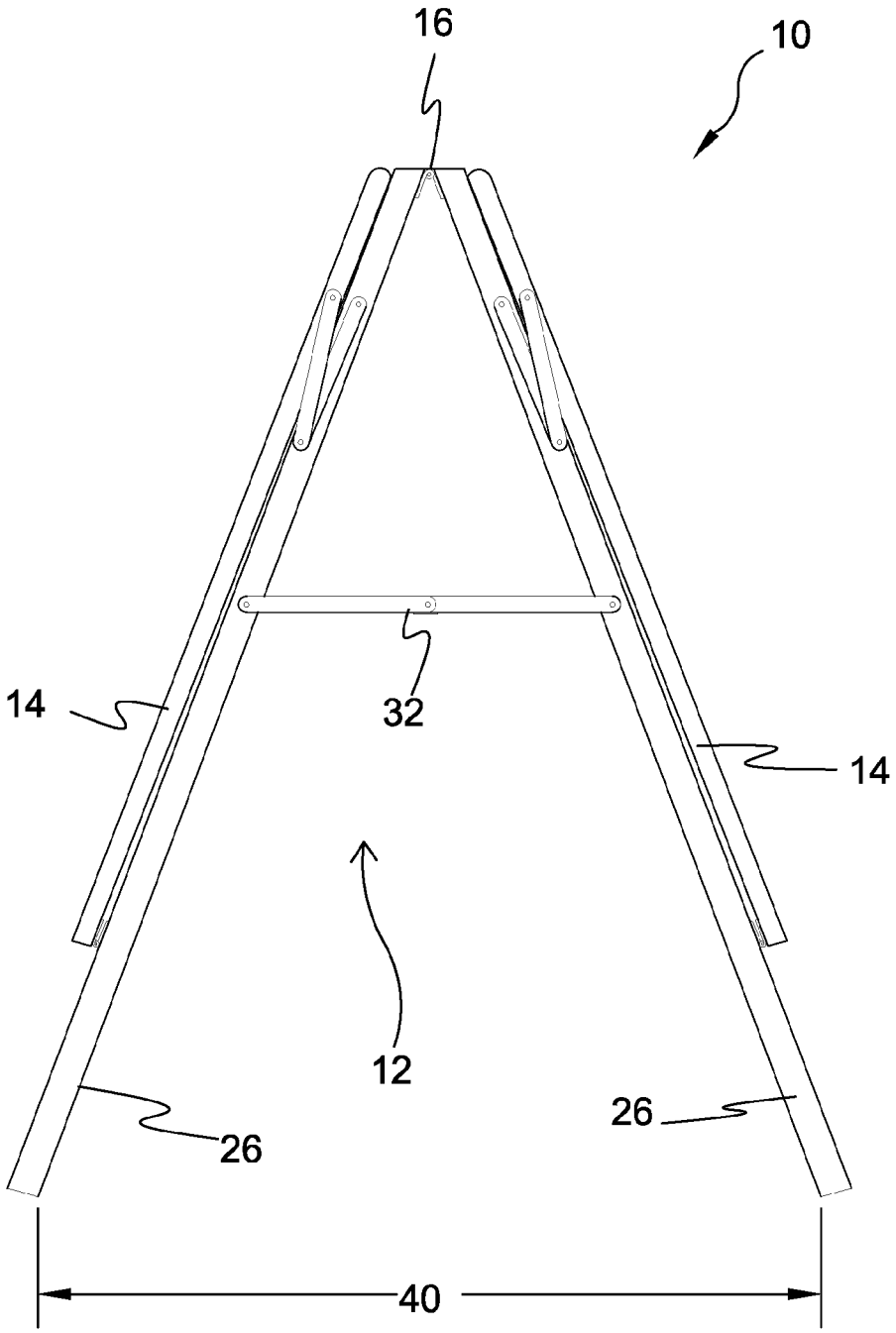
Figure 8:
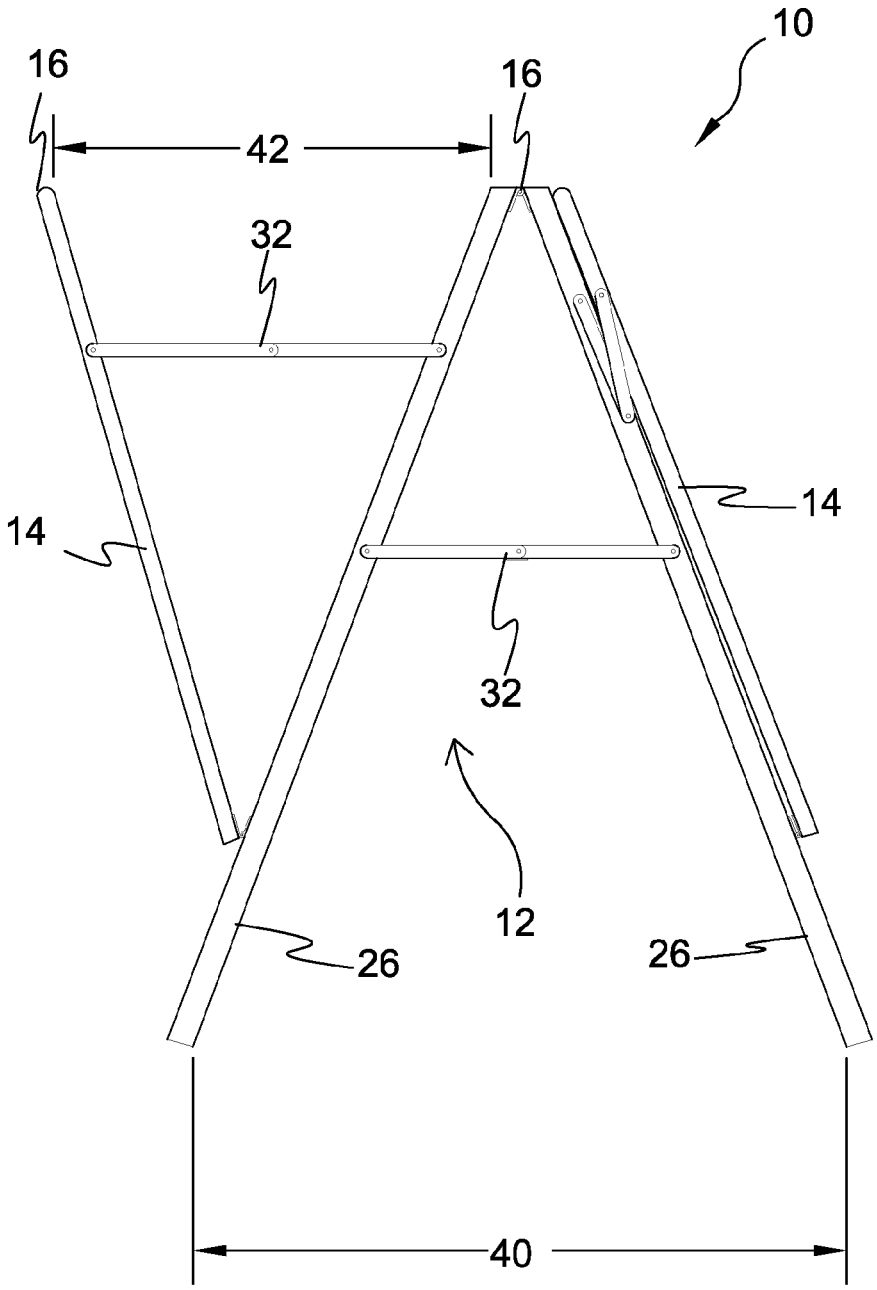
Figure 9:
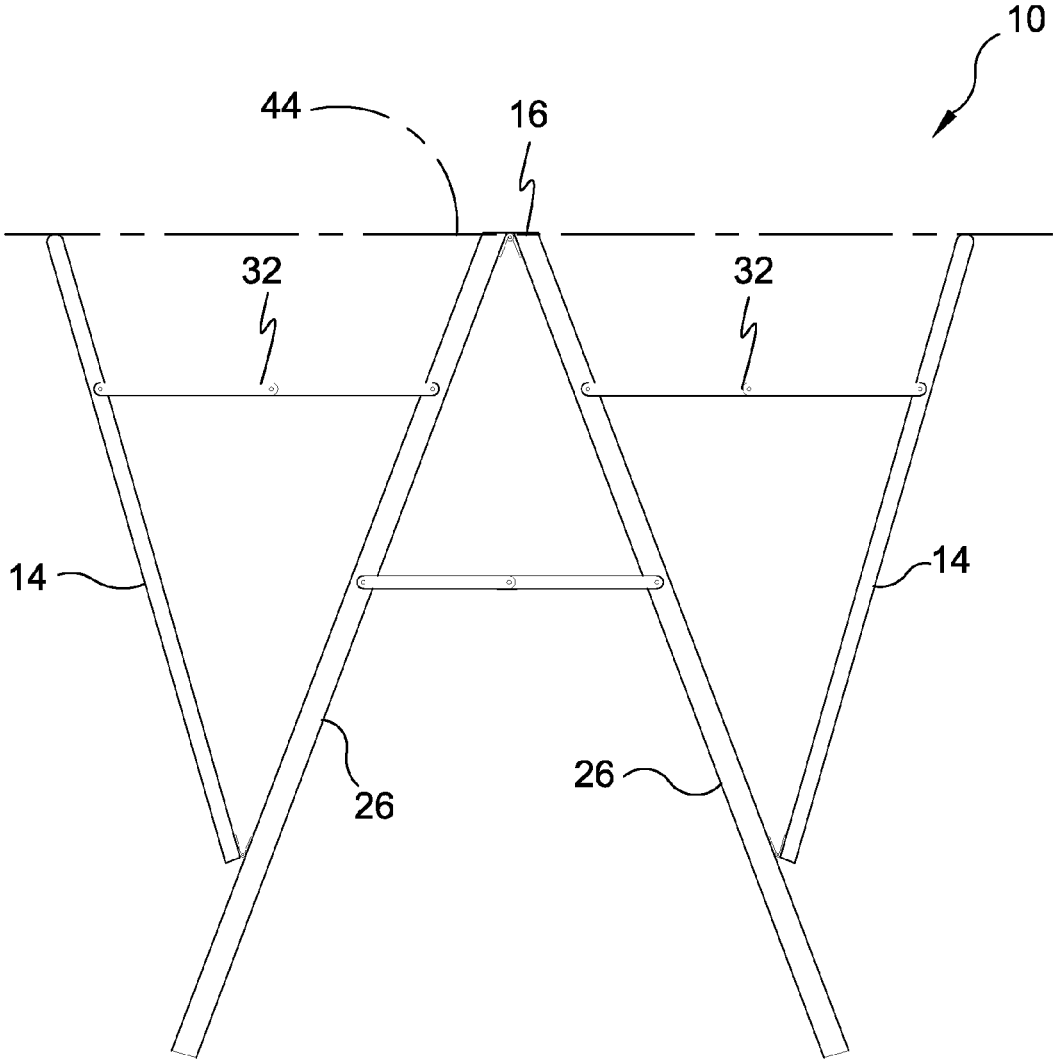

In order that the invention may be more fully understood, it will now be described, by way of example, with reference to the accompanying drawing in which:

FIG. 1 is an illustrative view of the present invention in use.
FIG. 2 is a perspective view of the present invention.
FIG. 3 is a perspective view of the present invention.
FIG. 4 is a perspective view of the present invention.
FIG. 5 is a perspective view of the present invention.
FIG. 6 is a side view of the present invention.
FIG. 7 is a side view of the present invention.
FIG. 8 is a side view of the present invention.
FIG. 9 is a side view of the present invention.

DESCRIPTION OF THE REFERENCED NUMERALS

Turning now descriptively to the drawings, in which similar reference characters denote similar elements throughout the several views, the figures illustrate the Saw Horse with Pivotable, Cantilevered Support Members of the present invention. With regard to the reference numerals used, the following numbering is used throughout the various drawing figures.

10 Saw Horse with Pivotable, Cantilevered Support Members of the present invention
12 saw horse
14 cantilevered support member
16 support beam
18 workpiece
20 user
22 leg frame
24 cross beam of 22
26 leg of 22
28 hinge
30 outer surface of 26
32 folding hinge spanner
34 extension arm
36 proximal end of 34
38 distal end of 34
40 distance of separation of 26
42 distance of separation of 14
44 horizontal plane

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is the user 20 using the present invention 10 to support a workpiece 18. The present invention is a collapsible saw horse 12 with a pair of pivotal cantilevered support members 14 that also have a support beam 16 extending therebetween with the support members 14 hingedly attached to a respective saw horse leg. Said saw horse 12 forming a configurable work piece support by extending one or both of the cantilevered support members 14 thereby having two or three support beams 16 supporting the work piece.

FIG. 2 is a perspective view of the present invention 10 in the folded position. The present invention 10 comprises a saw horse 12 comprising a pair of leg frames 22 having cross beams 22 hingedly 28 connected to each other forming a single support beam 16 with each said cross 14 having a leg 26 extending from the ends thereof. The outer surface 30 of each leg 26 has a cantilevered support member 14 hingedly 28 secured thereto and the support member 14 sits flush against the saw horse 12 when folded into the closed position. Folding hinge spanners 32 are disposed to regulate the distance of separation of the saw horse legs 26 and the support members 14. When in the fully folded position, the present invention 10 may be transported and stored in a compact manner.

FIG. 3 is a perspective view of the present invention 10. Shown is the collapsible saw horse of the present invention 10 in a partially folded position, with the hingedly 28 attached right side and left side legs 26 pivoted apart with folding hinge spanner 32 in a locked position. The support members 14 have extension arms 34 having a proximal end 36 hingedly secured to a mid to lower portion of its respective leg 26 and a distal end 38 with a support beam 16 communicating with the corresponding arm 34. The extension arm support beam 16 is dimensioned and configured to sit flush with that of the saw horse 12 when in the closed position.

FIG. 4 is a perspective view of the present invention 10. Shown is the collapsible saw horse 12 in an open position, having one cantilevered work piece support member 14 extended away from its folded position. The folding hinge spanners 32 determine the angular separation between the saw horse legs 26 and the support member 14 and the respective legs 26.

FIG. 5 is a perspective view of the present invention 10. Shown is the collapsible saw horse 12 in an open position, having both cantilevered work piece support members 14 extended away from its folded position. The folding hinge spanners 32 determine the angular separation between the saw horse legs 26 and the support member 14 and the respective legs 26.

FIG. 6 is a side view of the present invention 10 in the folded position. The present invention 10 comprises a saw horse 12 comprising a pair of leg frames 22 having cross beams 22 hingedly 28 connected to each other forming a single support beam 16 with each said cross 14 having a leg 26 extending from the ends thereof. The outer surface 30 of each leg 26 has a cantilevered support member 14 hingedly 28 secured thereto and the support member 14 sits flush against the saw horse 12 when folded into the closed position. Folding hinge spanners 32 are disposed to regulate the distance of separation of the saw horse legs 26 and the support members 14.

FIG. 7 is a side view of the present invention 10. Shown are the legs 26 of the saw horse 12 in the fully opened position with distance of separation 40 determined by the folding hinge spanner 32 that is in the locked open position. The cantilevered support members 14 remain flush against the legs 26 thus forming a single support beam 16 for use as a conventional saw horse 12.

FIG. 8 is a side view of the present invention 10. Shown are the legs 26 of the saw horse 12 in the fully opened position with distance of separation 40 determined by the folding hinge spanner 32 that is in the locked open position. One support member 14 is locked open to provide two parallel support beams 16 to support a workpiece and the distance of separation 42 between the support member 16 and that of the saw horse 12 is determined by its hinge spanner 32. The other support member 14 remains in the unfolded position.

FIG. 9 is a side view of the present invention 10 with both support members 14 employed to provide three support beams 16 that are assured to be on the same horizontal plane 44 due to the placement and dimensioning of the folding hinge spanners 32 communicating between the support members 14 and their respective saw horse legs 26.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A sawhorse consisting of:

a pair of leg frames for supporting said sawhorse on a horizontal surface, each leg frame having an elongate cross beam, each leg frame having first and second support legs, each cross beam having first and second ends, each said first support leg being connected to its respective cross beam at the first end thereof, each first support leg extending transverse to its respective cross beam, each said second support leg being connected to its respective cross beam at the second end thereof, each second support leg extending transverse to its respective cross beam, each cross beam having opposed front and rear faces joining opposed upper and lower faces, the front and rear faces each having a height and the upper and lower faces each having a width, hinges pivotally connecting said pair of leg frames, the hinges disposed between the rear faces of the cross beams of adjacent leg frames, the support legs having opposed front and rear faces joining opposed side faces, the front faces of the support legs of a leg frame being in substantially the same plane as the front face of the cross beam of the same leg frame, the rear faces of the support legs of a leg frame being substantially in the same plane as the rear face of the cross beam of the same leg frame, first and second folding hinge spanners secured between the support legs of opposing leg frames, the first and second folding hinge spanners limiting a separation distance between the support legs of opposing leg frames;

first and second cantilevered support frames, each cantilevered support frame having a support beam and first and second support arms, each support beam having first and second ends, each said first support arm being connected to its respective support beam at the first end thereof, each first support arm extending transverse to its respective support beam, each said second support arm being connected to its respective support beam at the second end thereof, each second support arm extending transverse to its respective support beam, each first support arm pivotally connected to its respective first support leg intermediate the first and second ends the first support leg, each second support arm pivotally connected to its respective second support leg intermediate the first and second ends of the second support leg, each of said cantilevered support frames pivotal from a closed position to an open position, third and fourth folding hinge spanners secured between the first cantilevered support frame and its respective leg frame limiting a separation distance between the support arm of the first cantilevered support frame and the support leg of its respective leg frame, fifth and sixth folding hinge spanners secured between the second cantilevered support frame and its respective leg frame limiting a separation distance between the support arm of the second cantilevered support frame and the support leg of its respective leg frame; and each folding hinge spanner having a central pivot joint allowing each folding hinge spanner to fold so that when the cantilevered support frames are in the closed position the third, fourth, fifth, and sixth folding hinge spanners are folded.

2. The sawhorse of claim 1, the third and fourth folding hinge spanners are pivotally attached to the support arms of the first cantilevered support frame closer to a top end of each support arm, the fifth and sixth folding hinge spanners are pivotally attached to the support arms of the second cantilevered support frame closer to a top end of each support arm, the third and fourth hinge spanners are pivotally attached to the support legs of their respective leg frame closer to a top end of each support leg, the fifth and sixth folding hinge spanners are pivotally attached to the support legs of their respective leg frame closer to a top end of each support leg.

3. The sawhorse of claim 2, the first and second folding hinge spanners are pivotally attached to the support legs of each leg frame at a position below the other folding hinge spanners.

4. The sawhorse of claim 3, the first and second folding hinge spanners are positioned above the pivotal connection of each cantilevered support frame.

5. The sawhorse of claim 1, each support beam having opposed front and rear faces joining opposed upper and lower faces, the upper faces of the cross beams and the upper faces of the support beams form a substantially horizontal plane for supporting a work piece when said leg frames are in the open position and said cantilevered support frames are in said open position.

* * * * *